US009196232B2

(12) United States Patent
Borisoff

(10) Patent No.: US 9,196,232 B2
(45) Date of Patent: Nov. 24, 2015

(54) SELF-COMPENSATING TUNABLE BRIDGE FOR STRING MUSICAL INSTRUMENT

(71) Applicant: David Joshua Borisoff, Ovid, NY (US)

(72) Inventor: David Joshua Borisoff, Ovid, NY (US)

(73) Assignee: Hipshot Products, Inc., Interlaken, NY (US)

( * ) Notice: Subject to any disclaimer, the term of this patent is extended or adjusted under 35 U.S.C. 154(b) by 0 days.

(21) Appl. No.: 14/694,992

(22) Filed: Apr. 23, 2015

(65) Prior Publication Data

US 2015/0310838 A1 Oct. 29, 2015

Related U.S. Application Data

(60) Provisional application No. 61/983,431, filed on Apr. 23, 2014.

(51) Int. Cl.
*G10D 3/14* (2006.01)
*G10D 3/04* (2006.01)

(52) U.S. Cl.
CPC ... *G10D 3/14* (2013.01); *G10D 3/04* (2013.01)

(58) Field of Classification Search
CPC ..... G10D 3/04; G10D 3/143; G10D 3/00
USPC ..... 84/299, 307–309
See application file for complete search history.

(56) References Cited

U.S. PATENT DOCUMENTS

| | | | | |
|---|---|---|---|---|
| 4,170,161 | A | 10/1979 | Kaftan | |
| 4,686,883 | A | 8/1987 | Piche et al. | |
| 4,878,413 | A | 11/1989 | Steinberger | |
| 5,438,902 | A | 8/1995 | Baker | |
| 5,460,072 | A | 10/1995 | Ferdon | |
| 5,528,970 | A | 6/1996 | Zacaroli | |
| 7,772,470 | B1 * | 8/2010 | Olsen | 84/313 |
| 2007/0240554 | A1 | 10/2007 | Hany | |

* cited by examiner

*Primary Examiner* — Kimberly Lockett
(74) *Attorney, Agent, or Firm* — Lance M. Pritikin

(57) ABSTRACT

A tunable bridge for a string musical instrument is provided to enable a user to rapidly switch between two pre-selected string tunings simply by movement of an actuator arm. The actuator arm controls the position of a cam roller assembly, which in turn controls the pivotal movement of a rocker arm between a lower position and an upper position. A multiplicity of string fingers are mounted for pivotable movement between respective first and second tuning positions. A plurality of manually-adjustable tuning screws with engagement tips are threadedly disposed in the rocker arm. Each engagement tip is configured to press against a respective string finger when the rocker arm is placed in its upper position, thereby further stretching the strings attached to the respective string fingers and increasing their pitch in accordance with the second pre-selected tuning. Mounting of the tunable bridge does not require permanent modification of the string instrument.

16 Claims, 13 Drawing Sheets

SELF-COMPENSATING TUNABLE BRIDGE FOR STRING MUSICAL INSTRUMENT

RELATED APPLICATIONS

This application claims the benefit of U.S. Provisional Patent Application No. 61/983,431 filed Apr. 23, 2014, the content of which is incorporated by this reference in its entirety for all purposes as if fully set forth herein.

TECHNICAL FIELD

The present invention relates generally to string musical instruments. More particularly, the invention relates to devices which support and facilitate the tuning of the strings of such instruments.

BACKGROUND

The use of the Resophonic Guitar has increased in popularity in many genres of music including Bluegrass, Folk, Country, Country Rock, and Rock and Roll. A popular style of resophonic guitar playing uses a bar, usually made of steel or brass and raised strings. The bar (or slide as it is commonly referred to) is held against the strings producing a slurring sound. The strings do not contact the fret board as is the case in traditional guitar playing. Also the instrument is generally held in a horizontal position as opposed to the usual vertical position that is popular in traditional guitar playing. This style of playing is similar to Hawaiian Steel Guitar or Lap Steel Guitar.

The resophonic guitar is usually tuned to an open chord, the popular tunings being Open D (DADF#AD) and Open G (GBDGBD). It would be a tremendous advantage if an instrument could be instantly retuned to either of these tunings with a single flip of a toggle lever during a song. Of course in doing so, many factors would have to be addressed. For convenience, the example of tuning between Open D and Open G tunings will be used for this patent application. It must be noted that there are many other tunings that lie within the scope of this invention. It must also be noted that although the resophonic guitar is highlighted in this application, the invention will work on many other types of acoustic and electric guitars as well as many other types of string musical instruments.

Manually retuning the guitar from one open tuning to another during a performance would not be practical. It would take many minutes to tune and retune the instrument. So if a performer would like to be able to switch from one tuning to another, traditionally two guitars would have to be used.

The open D tuning consists of the strings tuned to these specific notes: The $6^{th}$ string is D (which is stretched to about 21 pounds in tension), the $5^{th}$ is A (36 pounds), $4^{th}$ string is D (32 pounds), 3rd is F# (32 pounds), $2^{nd}$ is A (18 pounds) and $1^{st}$ is D (24 pounds). The total tension of all string applied to the guitar when tuned to open D is about 163 pounds.

The open G tuning consists of the strings tuned to the following notes; $6^{th}$ string is G (38 pounds), $5^{th}$ string is B (44 pounds), $4^{th}$ string is D (32 pounds), $3^{rd}$ string is G (36 pounds), $2^{nd}$ string is B (22 pounds) and the $1^{st}$ string is D (24 pounds). The total pounds applied to the guitar when tuned to an open G chord are about 196 pounds. The change of tension of the strings between Open D and Open G tuning totals approximately 33 pounds. A mechanical device would have to be developed to accurately and simultaneously retune this tension differential.

The following tuning charts are helpful in visualizing and comparing the Open D tuning with the Open G tuning

| OPEN D TUNING | |
|---|---|
| STRING | LBS |
| $1^{ST}$ STRING D | 24 |
| $2^{ND}$ STRING A | 18 |
| $3^{RD}$ STRING F# | 32 |
| $4^{TH}$ STRING D | 32 |
| $5^{TH}$ STRING A | 36 |
| $6^{TH}$ STRING D | 21 |

| OPEN G TUNING | |
|---|---|
| STRING | LBS |
| $1^{ST}$ STRING D | 24 |
| $2^{ND}$ STRING B | 22 |
| $3^{RD}$ STRING G | 36 |
| $4^{TH}$ STRING D | 32 |
| $5^{TH}$ STRING B | 44 |
| $6^{TH}$ STRING G | 38 |

In reviewing the charts, it is apparent that the $4^{th}$ string D and $1^{st}$ string D are common between the G and D tunings One might think that this would facilitate the rapid transition tuning between D and G tunings. However, as the $6^{th}$ string D tension is increased to G, the $5^{th}$ string A tension is increased to B, the $3^{rd}$ string F# tension is increased to G and the $2^{nd}$ string A tension is increased to B, a slight flexing or bending motion takes place in the instrument. This bending motion is much like how a bow deforms as an archer pulls the bow string back. Unlike the archer and bow, the deformation of the instrument is not as visually apparent. However it does affect the pitch of the common notes of the $1^{st}$ and $4^{th}$ strings. As the instrument bends inward (switching from D to G), the common strings slacken slightly which audibly lowers their pitch. Therefore it would be highly desirable that the device be able to automatically compensate for this drop of pitch incurred on the common strings.

As Resophonic guitars can be very expensive, it would be preferable that the invention mount to the instrument in such a manner as to not degrade or permanently alter the instrument.

It would be highly desirable that the invention also fit into the guitar case.

It would be important that the invention not detract from the aesthetic of the instrument.

It would be desirable that the invention be quickly tunable without the use of tools such as tuning wrenches.

Because the instrument is generally played acoustically, it is highly desirable that no electric power or any other alternative power be required to perform the tuning function.

Smooth, musical transition between tunings should be accomplished.

Because the instrument is acoustic and is very often amplified or recorded by the use of sensitive microphones, it is essential that the invention operate quietly and smoothly.

By the use of descriptions and figures, the following pages will show how embodiments of the present invention accomplish these objectives.

SUMMARY

Certain deficiencies of the prior art may be overcome by the provision of one or more embodiments of a self-compensating tunable bridge for string musical instrument.

An exemplary embodiment of a tunable bridge for a string musical instrument may comprise a base plate, a rocker arm, a cam roller fork, a cam roller, an actuator arm, a multiplicity of string fingers and a corresponding plurality of tuning screws.

The base plate is typically securable to the instrument without permanently modifying the instrument. The rocker arm may have a proximal portion, a distal portion and a rocker axis therebetween. The rocker arm is mounted for pivoting movement with respect to the base plate about the rocker axis between a lower position and an upper position. The rocker arm may include one or more noise attenuation pads configured to prevent direct contact between the rocker arm and the base plate when the rocker arm is in its lower position;

The cam roller fork is mounted for rotational movement with respect to the distal portion about a cam axis between a lock position and a release position. The cam roller is mounted to the cam roller fork and configured to contact the base plate for translational movement relative thereto when the cam roller fork is moved between its lock and unlock positions. The cam roller is preferably rotatably mounted to the cam roller fork for rotation about a roller axis such that the translational movement causes rolling contact between the cam roller and base plate. The cam roller may comprise one or more elastomeric rings disposed thereabout. The actuator arm is actuatable about the cam axis between a first arm position and a second arm position.

Each of the string fingers preferably has a tuning interface portion, a ball detent portion and a finger axis therebetween. Each ball detent portion is adapted to receive a string having a string ball, and to prevent the string ball from passing through the ball detent portion. Each string finger is mounted for pivotable movement with respect to the base plate about its finger axis between a first tuning position and a second tuning position. Each string finger preferably includes a foot on its ball detent portion. The foot is adapted to rest against the base plate when its respective string finger is in its first tuning position, thereby restraining the string finger from pivotal movement past its first tuning position in a direction away from its second tuning position.

Each tuning screw preferably has an engagement tip and is threadedly disposed in the proximal portion for adjustable placement of the engagement tip at a respective axial distance therefrom. Each of the engagement tips is configured to pressingly engage a respective tuning interface portion.

Actuation of the actuator arm to the second arm position forces the cam roller fork into its lock position. This in turn forces the rocker arm toward its upper position. Movement of the rocker arm to its upper position causes one or more of the tuning screw engagement tips to come into pressing engagement with their respective string finger tuning interface portion so as to impose a pivoting force on the respective string finger about its finger axis toward its second tuning position. This in turn causes respective strings to tighten to a preselected degree, thereby causing the instrument to almost instantaneously achieve a second tuning Actuation of the actuator arm from its second arm position toward its first arm position forces the cam roller fork out of its lock position, thereby allowing the instrument to rapidly return to its first tuning

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
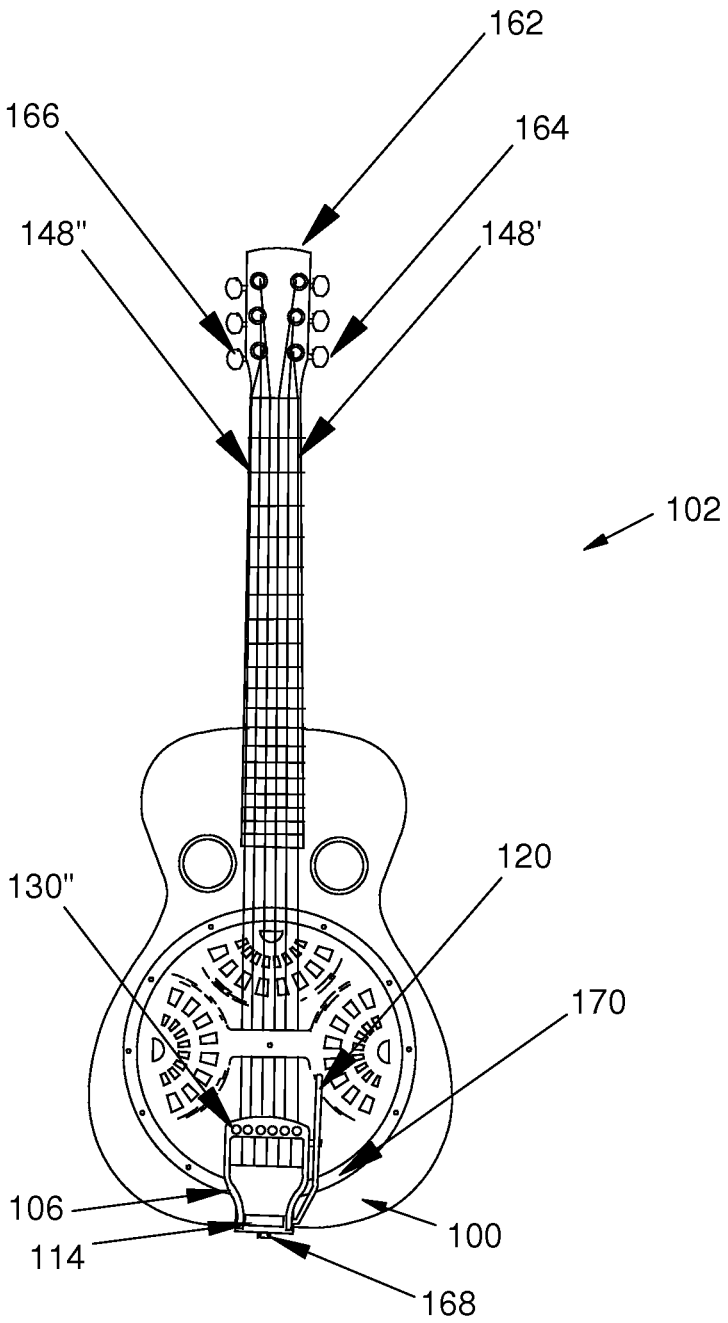
FIG. 1 is a diagrammatic plan view of a resophonic guitar featuring one example embodiment of a tunable bridge in accordance with the present invention.

Referring now to the drawings, like reference numerals designate identical or corresponding features throughout the several views.

FIG. 1 depicts the plan view of a resophonic guitar 102 with the invention 100 installed at the tail piece area 170 of the instrument. Note that each string (strings 1-6) has a corresponding tuning machine mounted at the instrument's peg head 162 as is customary in the art. The first string is depicted at 148', and the sixth string is depicted at 148". Correspondingly, the first string tuning machine is shown at 164, whereas the sixth string tuning machine is shown at 166. Also note that the invention possesses an alternate set of 6 tuning screws, (one tuning screw for each string). The sixth tuning screw is depicts at 130". FIG. 1 depicts the tuning actuator arm 120 which is in position "2", (parallel to the strings). This may also be referred to herein as the second arm position. For the example illustrated herein, position 2 will correspond to the Open G chord position. Also depicted in FIG. 1 are other various components including the rocker arm 106 and cam roller fork 114 which will be depicted in more detail in the following figures.

Figure 2:
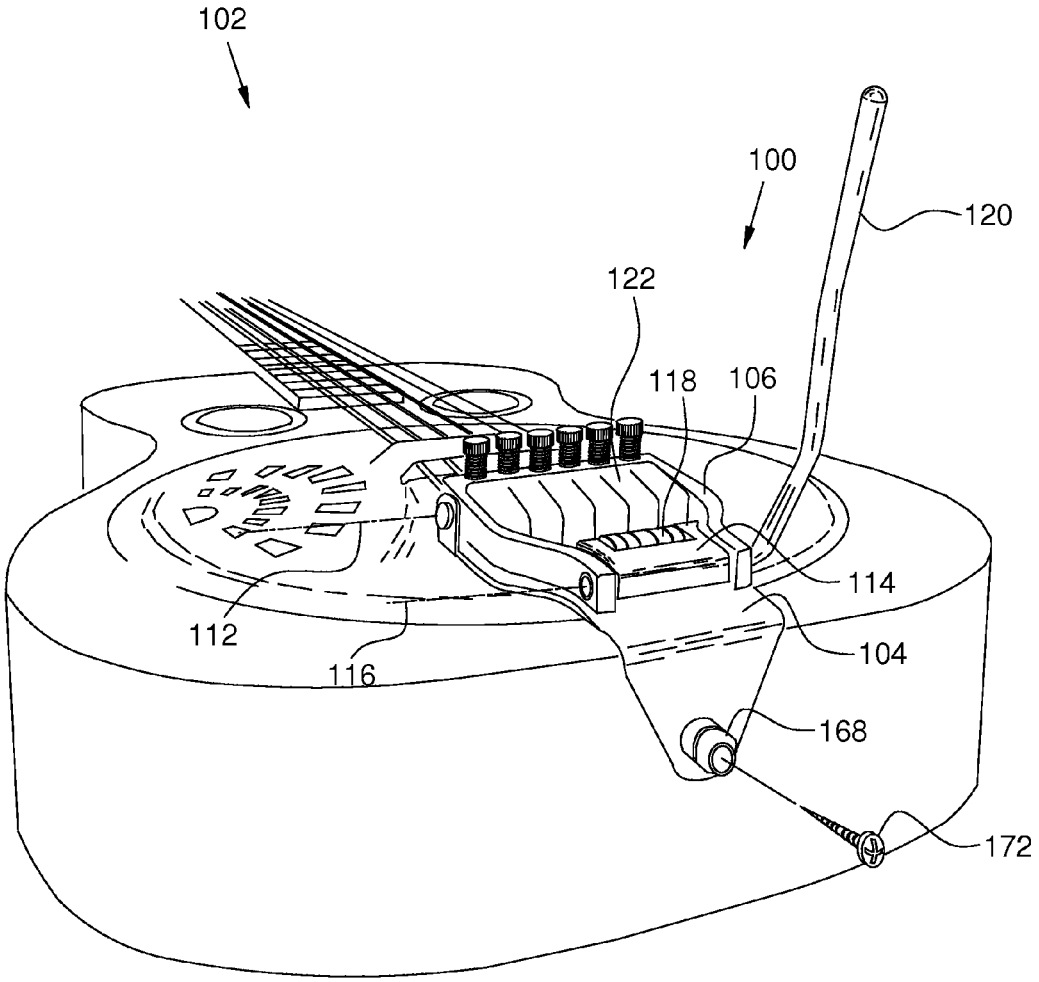
FIG. 2 is a diagrammatic partial perspective view of the guitar and tunable bridge of FIG. 1, wherein the actuator arm is in its first arm position and the rocker arm is resultingly in its lower position.

FIG. 2 is a perspective drawing of the rear area of the guitar and an embodiment of the invention showing a method of fastening the invention to the guitar. The embodiments of the invention may preferably use the same mounting method as the original tailpiece 170; a single screw 172 which secures the base plate 104 to the guitar and also secures the strap button 168 in place. In preferred embodiments, because no other fastening points are required, there is no modification or alteration to the original instrument necessary. By using the same screw mounting point, installation of preferred embodiments of the invention is greatly simplified. The base plate 104 may provide the platform for which all other components are mounted. A rocker arm 106 may be pivotally connected to the base plate 104 around center line "C" (otherwise referred to herein as a rocker axis 112). The actuator arm 120, cam roller fork 114 and cam roller assembly is also preferably pivotally mounted to the rocker arm 106 at center line "B" (otherwise referred to herein as the cam axis 116). The tuning screws 130 are also preferably threaded into the rocker arm 106. Also pivotally attached to the base plate 104 are the string fingers 122. Each string 148 may be attached at its corresponding string finger 122 as shown, for example, in FIGS. 4 and 5. Note that the actuator arm 120 is in position 1 (rotated approximately 90 degrees to the arm depicted in FIG. 1). This may also be referred to herein as the first arm position. For the example shown herein, the Actuator Arm is in position 1 which will correspond to the Open "D" chord position. Also note that the Rocker Arm 106 is in contact with the base plate 104 in the embodiments shown.

Figure 3:
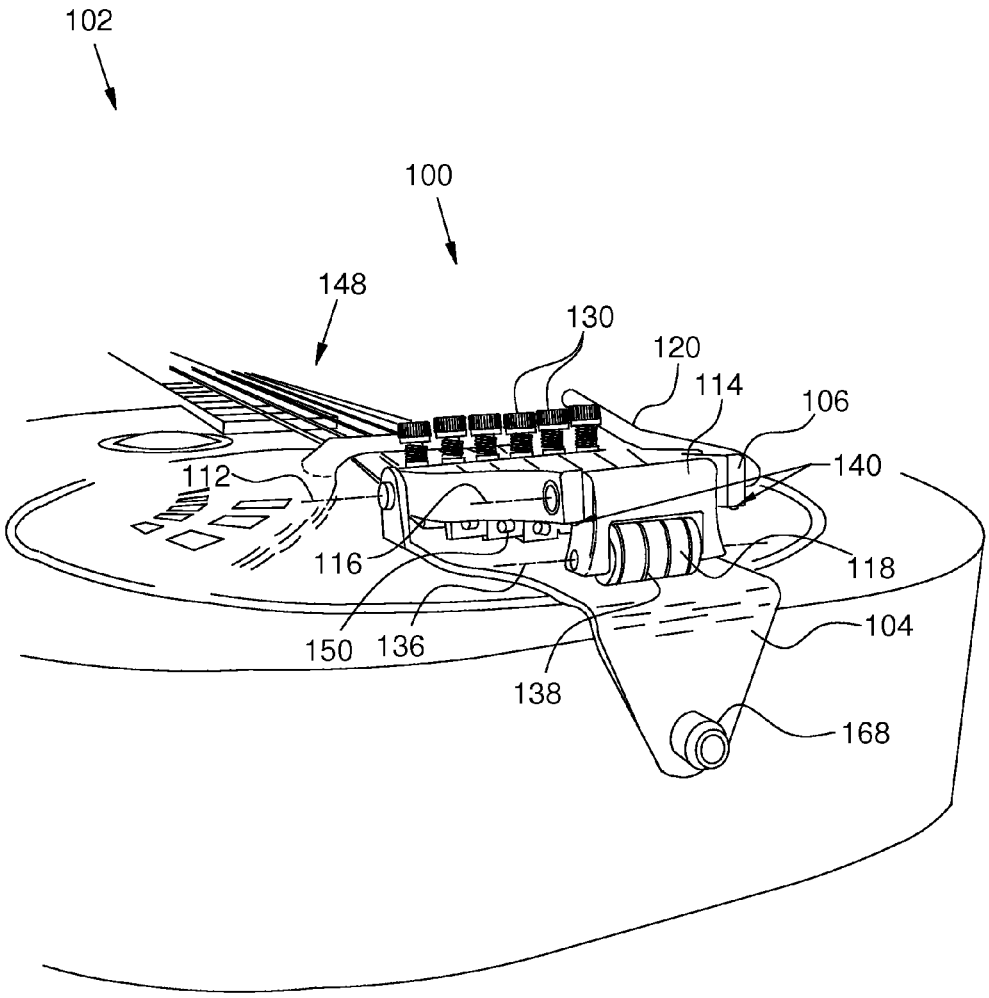
FIG. 3 is a diagrammatic partial perspective view similar to that of FIG. 2, but wherein the actuator arm is in its second arm position, the cam roller fork is rotated into its lock position and the rocker arm is resultingly maintained in its upper position.

FIG. 3 is another perspective drawing showing the rear view of the guitar and a preferred embodiment of the invention. It depicts the actuator arm 120 in position 2 (Open G chord Position), or second arm position. Note that the rocker arm 106 is lifted away from the base plate 104 by the cam roller 118. Also note that a pair of cork, rubber or soft plastic pads may be fastened to the underside of the rocker arm 106. These pads 140 eliminate any noise caused by contact between the rocker arm 106 and base plate 104 during use.

The cam roller 118 is preferably equipped with rubber or neoprene "O" rings 138. These "O" rings cushion and help eliminate the noise created by its contact to the base plate 104 as it is rotated to lift the rocker arm 106 up away from the base plate 104.

Figure 4:
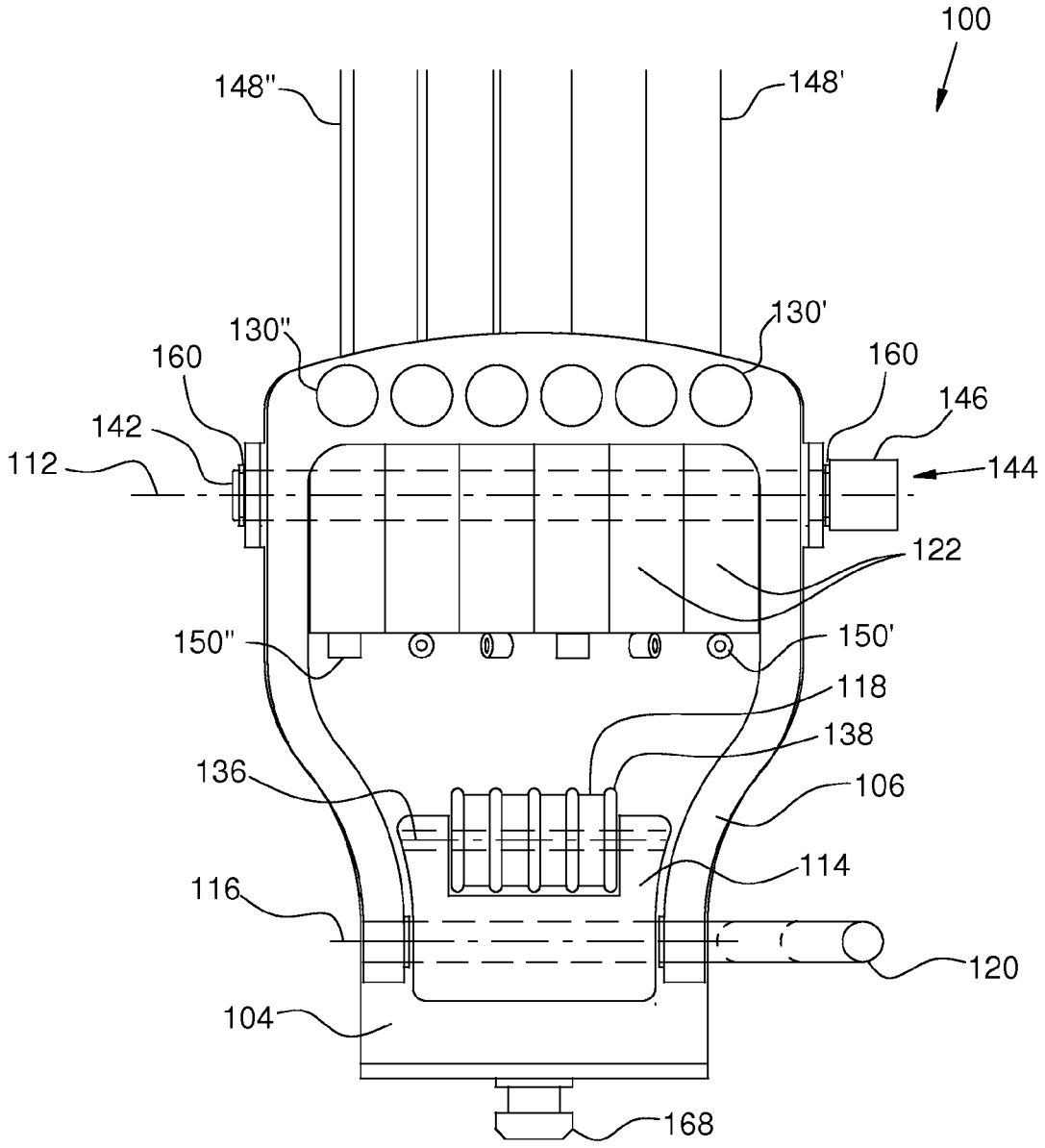
FIG. 4 is a diagrammatic plan view showing an example of a tunable bridge in accordance with the present invention, wherein the actuator arm is in its first arm position and the cam roller fork is rotated therewith to its unlock positon.

FIG. 4 is close up plan view of an embodiment of the invention showing an actuator arm 120, cam roller fork 114 and cam roller 118 in the 1st or "D" position. The first string ball is shown at 150', and the sixth string ball is shown at 150". The detail of the cam roller fork 114 and cam roller 118 can more easily be seen. While the actuator arm 120 is pivotally mounted to the rocker arm at center line "B", the actuator arm and cam roller fork are preferably rigidly connected at approximately 90 degrees. The cam roller 118 is preferably pivotally connected to the cam roller fork 114 at center line "A" (which may also be refereed to herein as the roller axis 136). Note that the "O" rings 138 may preferably extend out from the surface of the cam roller 118 so that they contact the base plate 104 to cushion and muffle the contact noise created during the actuation process.

Figure 5:
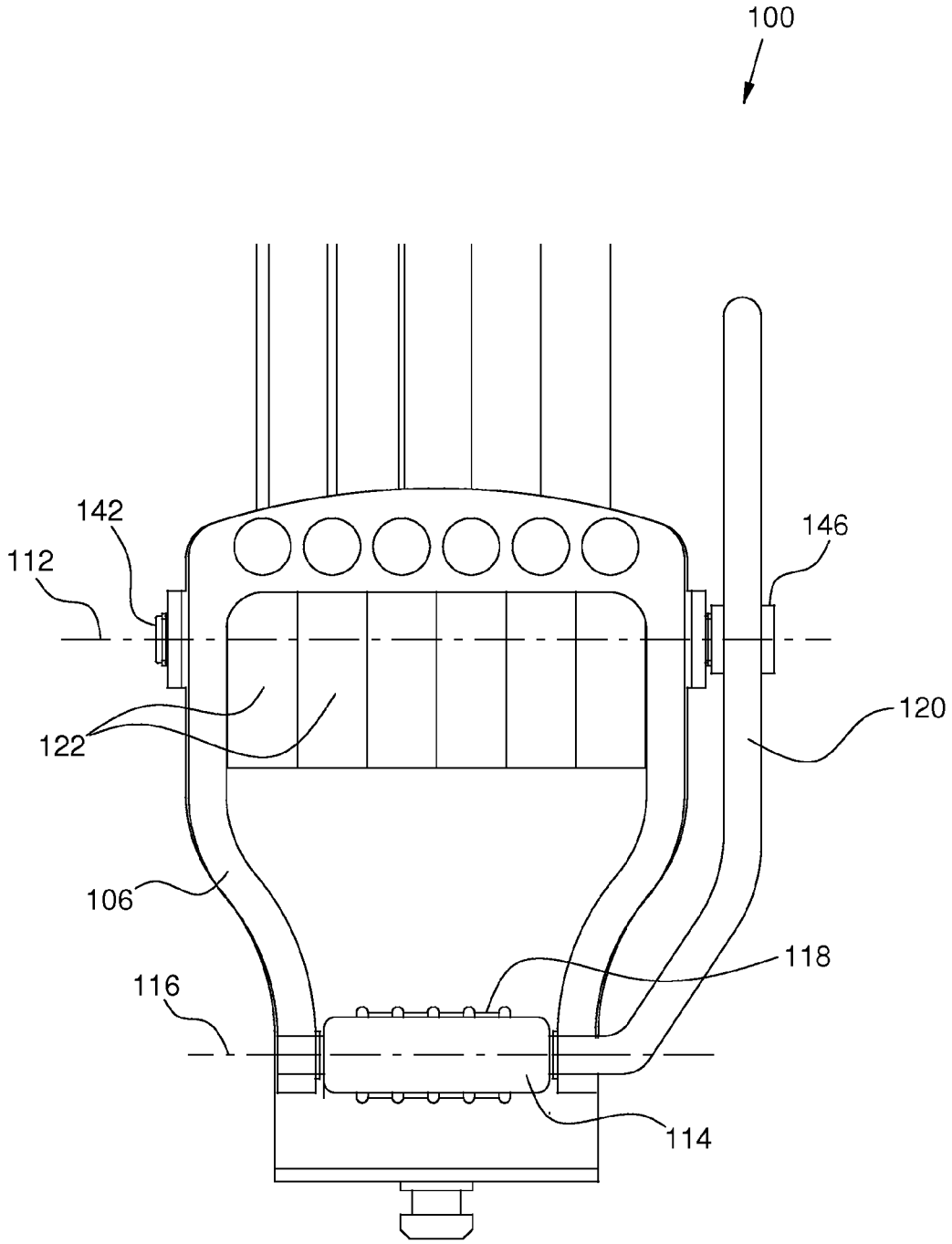
FIG. 5 is a diagrammatic plan view similar to that of FIG. 4, but wherein the actuator arm is in its second arm position and the cam roller fork is rotated therewith to its lock positon.

FIG. 5 is the same view as FIG. 4 except that the actuator arm 120 is shown in position 2 (in this case an Open G position), or second arm position. Note that the cam roller fork 114 and cam roller 118 have rotated approximately 90 degrees as it then rotates about the cam axis 116. In doing so, it lifts the rocker arm 106 to its upper position as depicted in FIG. 3. A soft rubber bumper 146 is preferably also mounted to the pivot axel 142 which acts as a stop for the actuator arm 120. This rubber bumper acts to eliminate any noise caused by the actuation of the bridge 100.

Figure 6:
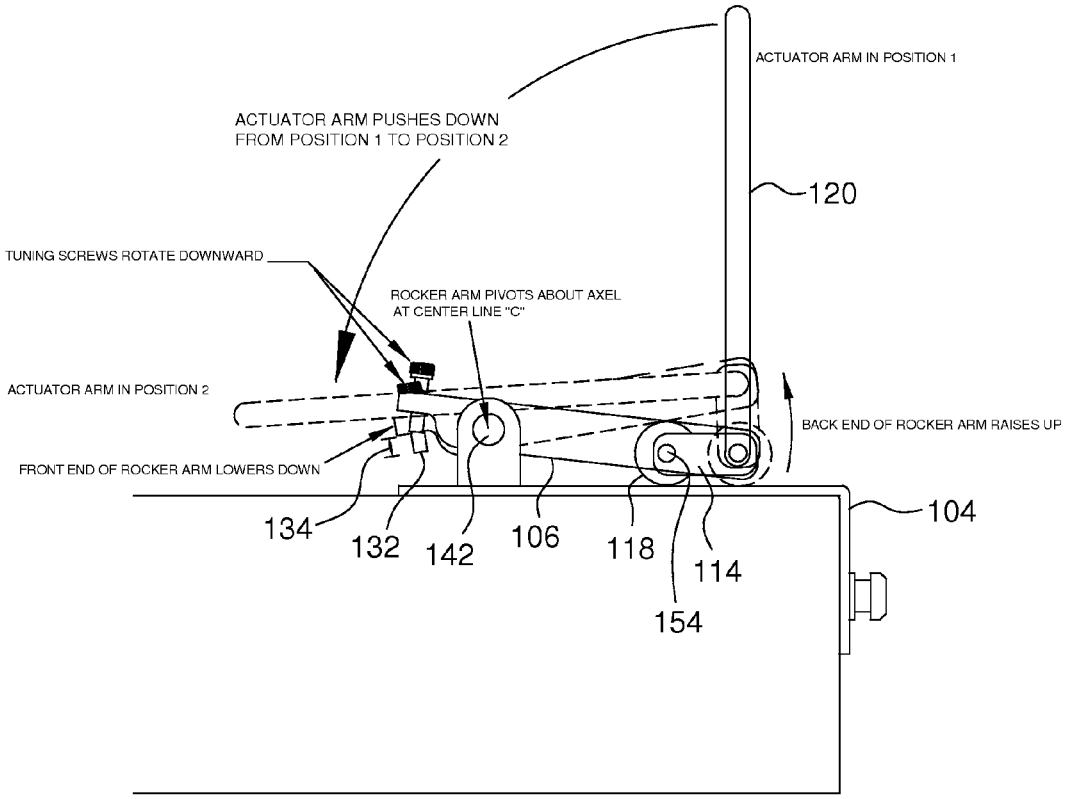
FIG. 6 is a diagrammatic side view of components of a tunable bridge, illustrating an example of the mechanical interaction between the cam roller assembly, including the actuator arm, cam roller fork, cam roller and rocker arm.

FIG. 6 is a side view of an embodiment of the invention specifically depicting the motion of the actuator arm 120, cam roller fork 114, cam roller 118 and rocker arm 106. For clarity, the string finger 122 has been omitted in this drawing. As the cam roller assembly is actuated by rotating the actuator arm 120 from position 1 (first arm position) to position 2 (second arm position), the rocker arm 106 pivots about center line C (rocker axis 112) in a counter clockwise direction. This action forces the tuning screws 130 downward against the string fingers as shown in FIG. 7.

Figure 7:
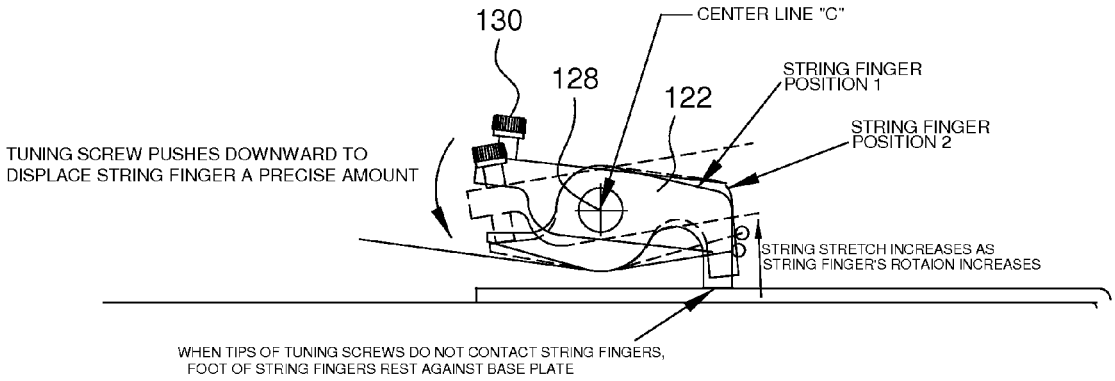
FIG. 7 is a further diagrammatic side view of components of a tunable bridge, illustrating an example of the mechanical interaction between a base plate, rocker arm, tuning screw, string finger and string.

FIG. 7 shows the preferred relationship between the rocker arm tuning screws, the string fingers and the strings. As the tuning screws are adjusted downward, the string finger's rotation is increased; therefore the strings are stretched farther. The farther the strings are stretched, the more their pitch is increased. Notice that when the tuning screws 130 are not in contact with the string fingers (as may be the case when the actuator arm is in position 1), the string tension pulls the string finger 122 in a clock wise direction so that the foot 152 of the string finger 122 comes to rest against the base plate 104.

Figure 8:
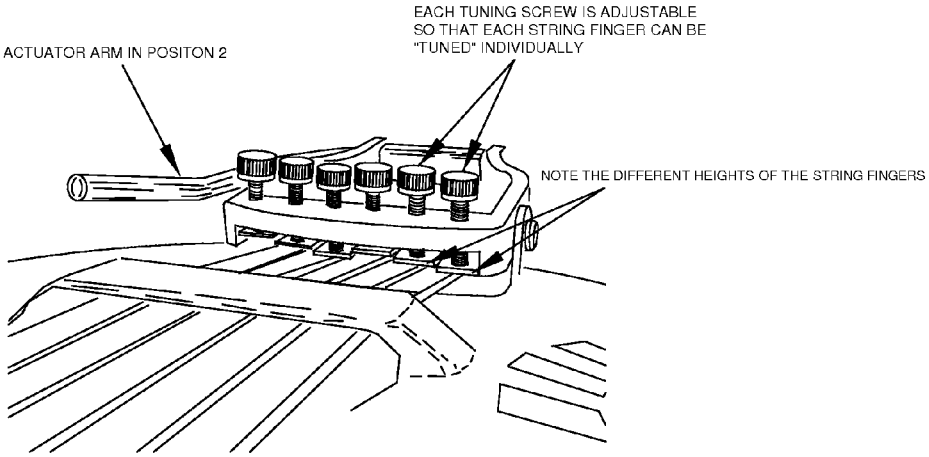
FIG. 8 is a diagrammatic partial perspective view of one embodiment of a tunable bridge, illustrating the ability to set the second tuning position of each individual string finger independently by way of respective manually-adjustable tuning screws.

The pitches of all strings 148 can be adjusted individually to attain an exact specific pitch for each string as shown in FIG. 8. Notice the different heights of the string fingers from the base plate 104. The tuning screws 130 are shown adjusted to retune the instrument to the open G tuning. Also notice that strings 1 and 4 string fingers are hardly displaced. This is because the pitches of string 1 (D) and string 4 (D) are common between the Open D tuning and the Open G tuning Only a very slight tuning is necessary to slightly sharpen their pitches to compensate for the flattening effect which occurs do to the bending of the instrument.

Figure 9:
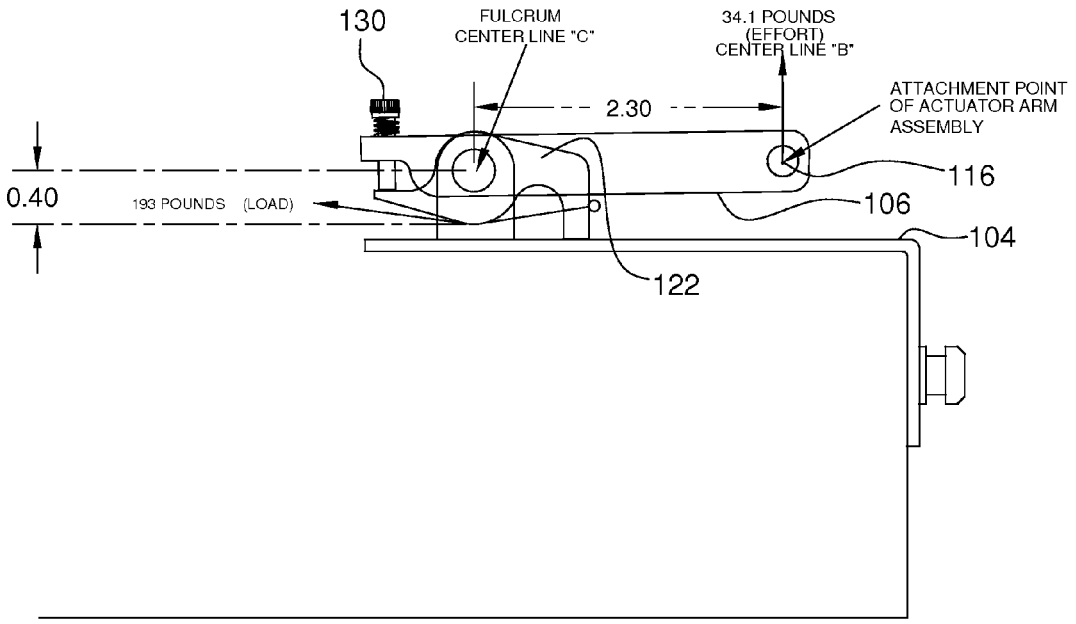
FIG. 9 is a diagrammatic side view of components of one embodiment of a tunable bridge, illustrating the potential mechanical advantage provided by a first lever system involving the interaction between a rocker arm, tuning screws, string fingers and strings.
Figure 10:
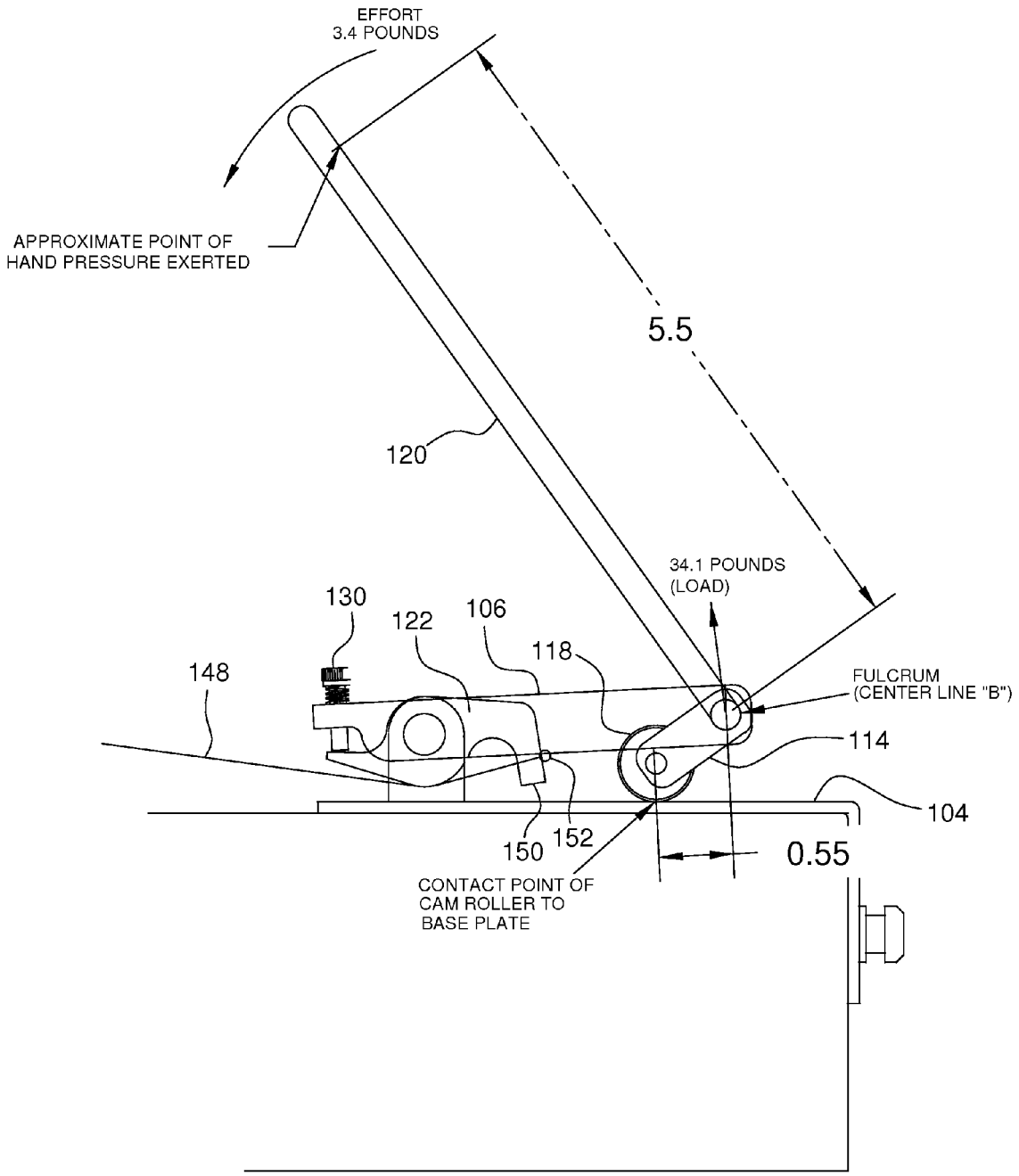
FIG. 10 is a further diagrammatic side view of components of one embodiment of a tunable bridge, illustrating the potential mechanical advantage provided by a second lever system involving the interaction between an actuator arm, cam roller fork, cam roller and rocker arm.

FIGS. 9 and 10 show the mechanical advantage designed into preferred embodiments of the invention. The maximum string tension is typically 196 pounds. Because embodiments of the invention must operate smoothly and easily within the normal and comfortable range of hand pressure, embodiments are preferably comprised of two lever systems.

FIG. 9 illustrates a first lever system which is comprised of the strings which represent the load of 196 pounds. The string finger/rocker arm assembly which rotates about Center line "C" is the lever arm. The attachment point of the actuator arm/cam roller fork/cam roller (Center line "B") is the point at which effort is exerted. By way of example, the calculations for determining the amount of effort needed to move 196 pounds of string force applied at Point "B" is as follows: 2.30/0.4=5.75:1 (mechanical advantage). Therefore 196 pounds/5.75=34.1 pounds of effort needed at center line "B'.

FIG. 10 illustrates a second lever needed to reduce the load of 34.1 pounds further. The contact point of the cam roller 118 to the base plate 104 is the fulcrum. Note that the fulcrum point does shift as the roller moves along the base plate 104. However for the purpose of this example, the average distance of 0.55 inches is used. The point of pressure exerted at the Actuator Arm is approximately 5.5 inches from the fulcrum point. Therefore the calculation is as follows: 5.5/0.55=10:1. Therefore the amount of force needed to move the load of 34.1 pounds at center line "B" is 3.4 pounds. Such embodiment of the invention successfully reduces the force of 196 pounds to a very manageable force of 3.4 pounds.

Figure 11:
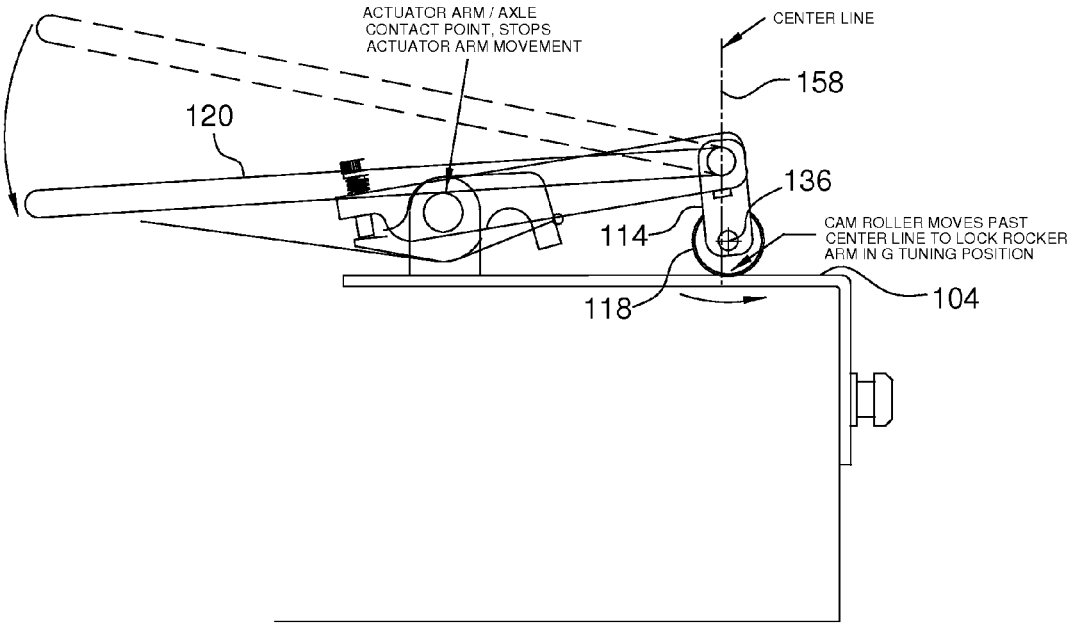
FIG. 11 is a further diagrammatic side view of components of one embodiment of a tunable bridge, illustrating the cam roller fork moving into its lock position as a result of the actuator arm being moved into its second arm position.

FIG. 11 illustrates the locking mechanism used to secure the actuator arm/roller cam mechanism into the G (or high tension) position. By moving the roller cam just past center line (or locking axis) 158, string pressure forces the cam roller "back up". However its movement is halted by the contact between the actuator arm 120 and rubber bumper 146 of the axle 142 at center point "C".

An exemplary embodiment of a tunable bridge 100 for a string musical instrument 102 may preferably comprise a base plate 104, a rocker arm 106, a cam roller fork 114, a cam roller 118, an actuator arm 120, a multiplicity of string fingers 122 and a plurality of tuning screws 130. As illustrated in FIG. 2, the base plate 104 may be securable to the tailpiece section 170 of the musical instrument 102 by way of a single conventional mount screw. Such a mount screw may be provided without modifying the instrument, as it may, for example, already serve the purpose of mounting the original tailpiece and pre-existing strap button 168 to the instrument.

Figure 14:
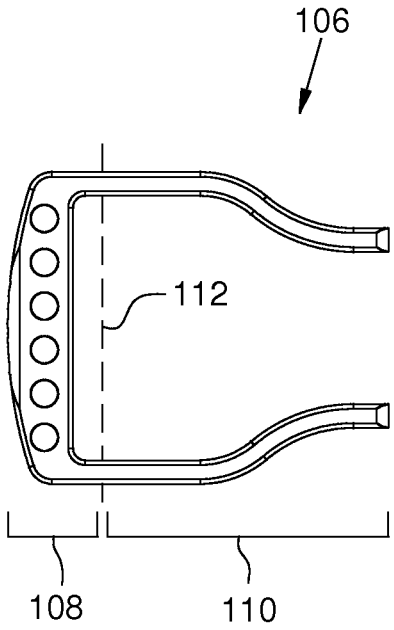
FIG. 14 is a diagrammatic plan view of one embodiment of a rocker arm.
Figure 15:
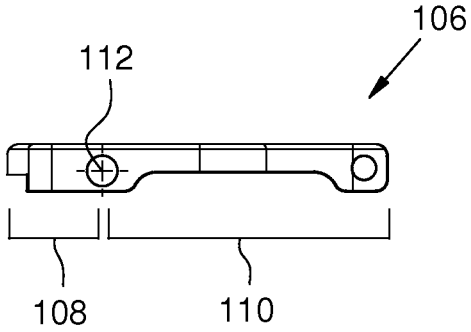
FIG. 15 is a diagrammatic side view of the rocker arm shown in FIG. 14.

Referring to FIGS. 14 and 15, a rocker arm 106 may have a proximal portion 108, a distal portion 110 and a rocker axis 112 therebetween. The rocker arm 106 may be mounted for pivoting movement with respect to the base plate 104 about the rocker axis 112 between a lower position (see, for example, FIG. 2) and an upper position (see, for example, FIGS. 3 and 12).

A cam roller fork 114 may be mounted for rotational movement with respect to the distal portion 110 of the rocker arm 106 about a cam axis 116 between a lock position (see, for example, FIGS. 3, 11 and 12) and a release position (see, for example, FIGS. 2 and 4). Referring to FIG. 6, a cam roller 118 may be mounted to the cam roller fork 114 and configured to contact the base plate 104 for translational movement relative thereto when the cam roller fork 114 is moved between its lock and unlock positions. An actuator arm 120 may be actuatable about the cam axis 116 between a first arm positions (see, for example, FIG. 4) and a second arm position (see, for example, FIG. 5). In certain preferred embodiments, the actuator arm 120 and cam roller fork 114 are rigidly connected to one another.

Figure 16:
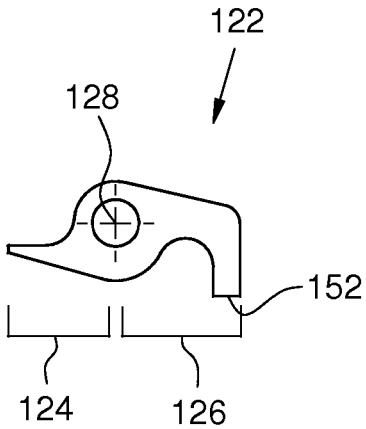
FIG. 16 is a diagrammatic side view of one embodiment of a string finger.

Referring to FIG. 16, each string finger 122 may have a tuning interface portion 124, a ball detent portion 126 and a finger axis therebetween 128. Each string finger 122 may be mounted for pivotable movement with respect to the base plate 104 about its finger axis 128 between a first tuning position (see, for example, FIG. 9) and a second tuning position (see, for example, FIG. 11). Referring to FIGS. 3, 4 and 10, each ball detent portion 126 is preferably adapted to receive a string 148 having a string ball 150, and to prevent the string ball 150 from passing through the ball detent portion 126. Each of the string fingers may include a foot 152 on its ball detent portion 126. Referring to FIG. 7, such a foot 152 may be adapted to rest against the base plate 104 when its respective string finger 122 is in its first tuning position, thereby restraining the string finger 122 from pivotal movement past its first tuning position in a direction away from its second tuning position.

Figure 13:
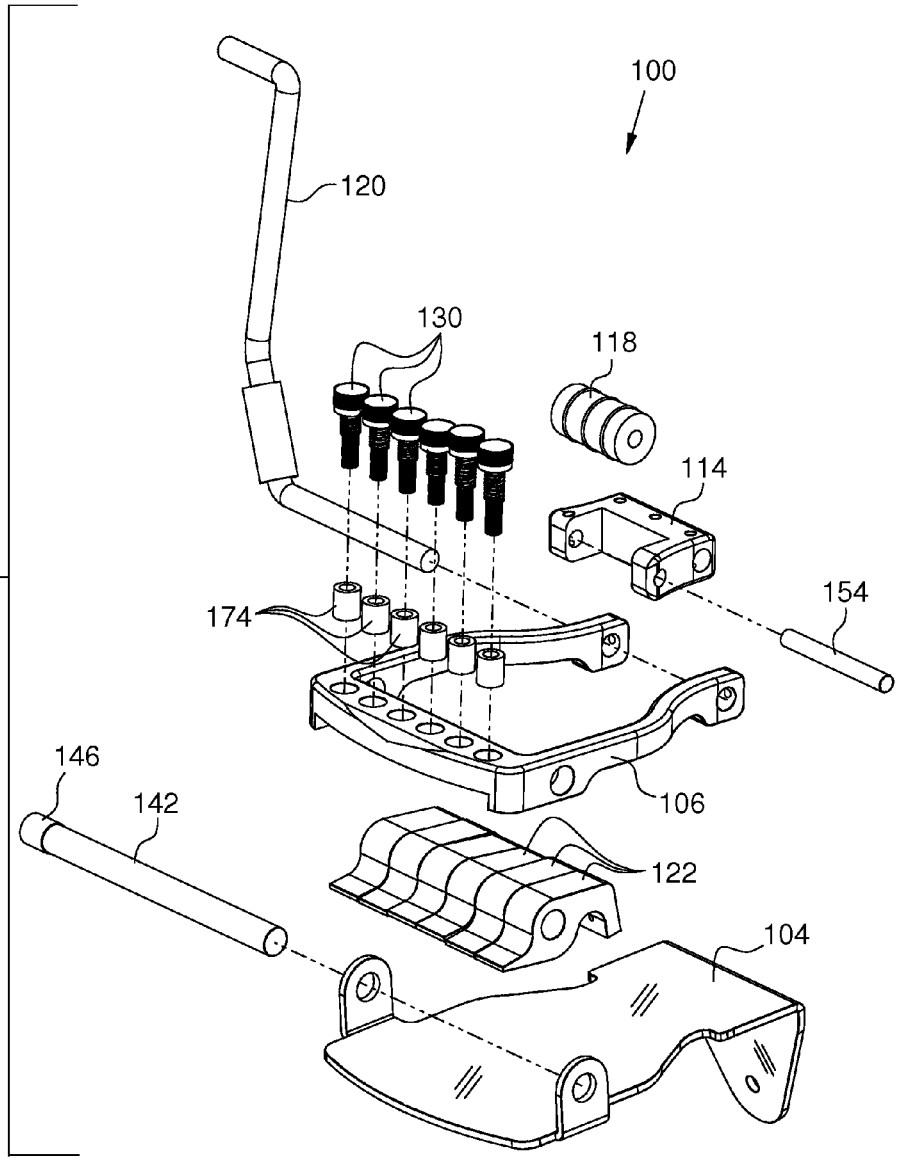
FIG. 13 is an exploded view of the embodiment of a tunable bridge shown in FIG. 12.

Referring to FIGS. 6 and 10, each tuning screw 130 may have an engagement tip 132 and be threadedly disposed in the proximal portion 108 of the rocker arm 106 for adjustable placement of the engagement tip 132 at a respective axial distance 134 therefrom. Each of the engagement tips may preferably be configured to pressingly engage a respective tuning interface portion 124. Referring to FIG. 13, in certain embodiments, inserts 174 may be disposed between the tuning screws 130 and the proximal portion 108 of the rocker arm 106.

Referring to FIGS. 10 and 11, in certain preferred embodiment of a tunable bridge, actuation of the actuator arm 120 to the second arm position is adapted to force the cam roller fork into its lock position (see, for example, FIG. 11). Moreover, movement of the cam roller fork 114 toward its lock position is typically adapted to force the rocker arm 106 toward its upper position. Referring to FIGS. 6 and 7, movement of the rocker arm 106 to its upper position is adapted to cause one or more engagement tips 132 to each come into pressing engagement with the respective tuning interface portion 124 so as to impose a pivoting force on the respective string finger 122 about its finger axis 128 toward its second tuning position. Further, referring to FIGS. 2 and 4, actuation of the actuator arm 120 from its second arm position toward its first arm position is preferably adapted to force the cam roller fork 114 out of its lock position.

In particular preferred embodiments, the cam roller 118 may be rotatably mounted to the cam roller fork 114 for rotation about a roller axis 136 such that the translational movement causes rolling contact between the cam roller 118 and the base plate 104. A cam axle 154 may be provided to facilitate this rotatable mounting. Moreover, the cam roller 118 may comprise one or more elastomeric (e.g., rubber) O-rings 138 disposed thereabout.

Referring to FIG. 3, in certain preferred embodiments, the rocker arm 106 may include one or more noise attenuation pads 140 on the distal portion 110. Such noise attenuation pads may be configured, for example, to prevent direct contact between the rocker arm 106 and the base plate 104 when the rocker arm 106 is in its upper position. Such noise attenuation pads 140 may be adhered to the rocker arm 106, and may be made of a material such as cork, rubber, plastic or the like.

Figure 12:
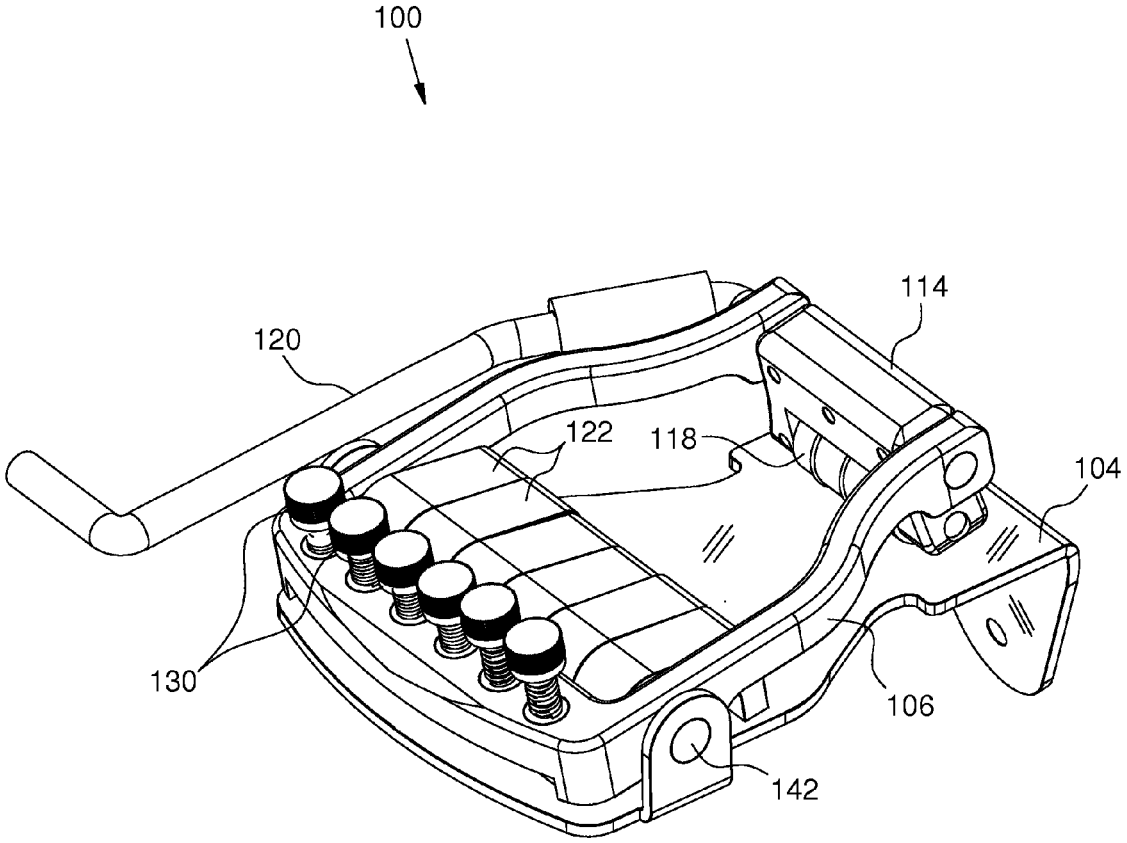
FIG. 12 is a diagrammatic perspective view of an embodiment of a tunable bridge in accordance with the present invention, wherein the actuator arm is shown in its second arm positon, the cam roller fork is shown in its lock position and the rocker arm is shown in its upper position.

Referring to FIGS. 4, 12 and 13, in particular preferred embodiments, the rocker arm 106 and string fingers 122 may be mounted to the base plate 104 for their respective pivotal movement by way of an axle 142. This axle 142 may also include an arm detent 144 configured to engage the actuator arm 120 when in its second arm position, and limit further movement of the actuator arm toward the base plate 104. In embodiments, the arm detent may include an elastomeric bumper element 146 to dampen or eliminate noise which may otherwise result from the contact between the actuator arm 120 and the arm detent 144. As illustrated in FIGS. 4 and 5, the axle may be held in place with respect the base plate 104 by way of, for example, snap rings 160.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tunable bridge for a string musical instrument, said tunable bridge comprising:

a base plate securable to said string musical instrument;

a rocker arm having a proximal portion, a distal portion and a rocker axis therebetween, said rocker arm being mounted for pivoting movement with respect to said base plate about said rocker axis between a lower position and an upper position;

a cam roller fork mounted for rotational movement with respect to said distal portion about a cam axis between a lock position and a release position;

a cam roller mounted to said cam roller fork and configured to contact said base plate for translational movement relative thereto when said cam roller fork is moved between its lock and unlock positions;

an actuator arm actuatable about said cam axis between a first arm position and a second arm position;

a multiplicity of string fingers, each said string finger having a tuning interface portion, a ball detent portion and a finger axis therebetween, each said string finger being mounted for pivotable movement with respect to said base plate about its finger axis between a first tuning position and a second tuning position; and a plurality of tuning screws, each said tuning screw having an engagement tip and being threadedly disposed in said proximal portion for adjustable placement of said engagement tip at a respective axial distance therefrom, each of said engagement tips being configured to pressingly engage a respective said tuning interface portion.

2. A tunable bridge as defined in claim 1 wherein:

(a) actuation of said actuator arm to said second arm position is adapted to force said cam roller fork into its lock position;

(b) movement of said cam roller fork toward its lock position is adapted to force said rocker arm toward its upper position; and (c) movement of said rocker arm to its upper position is adapted to cause one or more said engagement tips to each come into pressing engagement with the respective said tuning interface portion so as to impose a pivoting force on the respective said string finger about its finger axis toward its second tuning position.

3. A tunable bridge as defined in claim 1 wherein actuation of said actuator arm from said second arm position toward said first arm position is adapted to force said cam roller fork out of its lock position.

4. A tunable bridge as defined in claim 1 in which said cam roller is rotatably mounted to said cam roller fork for rotation about a roller axis such that said translational movement causes rolling contact between said cam roller and said base plate.

5. A tunable bridge as defined in claim 4 in which said cam roller comprises one or more elastomeric rings disposed thereabout.

6. A tunable bridge as defined in claim 1 in which said rocker arm includes one or more noise attenuation pads on said distal portion, said noise attenuation pads being configured to prevent direct contact between said rocker arm and said base plate when said rocker arm is in its lower position.

7. A tunable bridge as defined in claim 6 in which said noise attenuation pads are made of a material selected from the group consisting of cork, rubber and plastic.

8. A tunable bridge as defined in claim 1 in which said rocker arm and string fingers are mounted to said base plate for respective said pivotal movement by way of an axle, said axle including an arm detent configured to engage said actuator arm when in its second arm position.

9. A tunable bridge as defined in claim 8 in which said arm detent includes an elastomeric bumper element.

10. A tunable bridge as defined in claim 1 in which said actuator arm and said cam roller fork are rigidly connected to one another.

11. A tunable bridge as defined in claim 1 in which each said ball detent portion is adapted to receive a string having a string ball, and to prevent said string ball from passing therethrough.

12. A tunable bridge as defined in claim 1 in which each of said string fingers includes a foot on its ball detent portion, said foot being adapted to rest against said base plate when its respective said string finger is in its first tuning position, thereby restraining said string finger from pivotal movement past said first tuning position in a direction away from said second tuning position.

13. A tunable bridge for a string musical instrument, said tunable bridge comprising:

a base plate securable to said string musical instrument;

a rocker arm having a proximal portion, a distal portion and a rocker axis therebetween, said rocker arm being mounted for pivoting movement with respect to said base plate about said rocker axis between a lower position and an upper position, said rocker arm including one or more noise attenuation pads on said distal portion, said noise attenuation pads being configured to prevent direct contact between said rocker arm and said base plate when said rocker arm is in its lower position;

a cam roller fork mounted for rotational movement with respect to said distal portion about a cam axis between a lock position and a release position;

a cam roller mounted to said cam roller fork and configured to contact said base plate for translational movement relative thereto when said cam roller fork is moved between its lock and unlock positions, said cam roller being rotatably mounted to said cam roller fork for rotation about a roller axis such that said translational movement causes rolling contact between said cam roller and said base plate, said cam roller comprising one or more elastomeric rings disposed thereabout;

an actuator arm actuatable about said cam axis between a first arm position and a second arm position, a multiplicity of string fingers, each said string finger having a tuning interface portion, a ball detent portion and a finger axis therebetween, each said ball detent portion being adapted to receive a string having a string ball, and to prevent said string ball from passing therethrough, each said string finger being mounted for pivotable movement with respect to said base plate about its finger axis between a first tuning position and a second tuning position, each of said string fingers including a foot on its ball detent portion, said foot being adapted to rest against said base plate when its respective said string finger is in its first tuning position, thereby restraining said string finger from pivotal movement past its first tuning position in a direction away from its second tuning position; and a plurality of tuning screws, each said tuning screw having an engagement tip and being threadedly disposed in said proximal portion for adjustable placement of said engagement tip at a respective axial distance therefrom, each of said engagement tips being configured to pressingly engage a respective said tuning interface portion.

14. A tunable bridge as defined in claim 13 wherein:

(a) actuation of said actuator arm to said second arm position is adapted to force said cam roller fork into its lock position;

(b) movement of said cam roller fork toward its lock position is adapted to force said rocker arm toward its upper position;

(c) movement of said rocker arm to its upper position is adapted to cause one or more said engagement tips to each come into pressing engagement with the respective said tuning interface portion so as to impose a pivoting force on the respective said string finger about its finger axis toward its second tuning position; and (d) actuation of said actuator arm from said second arm position toward said first arm position is adapted to force said cam roller fork out of its lock position.

15. A tunable bridge as defined in claim 13 in which said rocker arm and string fingers are mounted to said base plate for respective said pivotal movement by way of an axle, said axle including an arm detent configured to engage said actuator arm when in its second arm position, said arm detent including an elastomeric bumper element.

16. A tunable bridge as defined in claim 13 in which said actuator arm and said cam roller fork are rigidly connected to one another.

* * * * *